US012326044B2

(12) United States Patent
Zhang et al.

(10) Patent No.: US 12,326,044 B2
(45) Date of Patent: Jun. 10, 2025

(54) EROSION RESISTANT INSERT FOR DRILL BITS

(71) Applicant: Schlumberger Technology Corporation, Sugar Land, TX (US)

(72) Inventors: Youhe Zhang, Spring, TX (US); Huimin Song, Spring, TX (US); Steven G. Villareal, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/573,084

(22) PCT Filed: Jun. 24, 2022

(86) PCT No.: PCT/US2022/034945

§ 371 (c)(1),
(2) Date: Dec. 21, 2023

(87) PCT Pub. No.: WO2022/272092

PCT Pub. Date: Dec. 29, 2022

(65) Prior Publication Data

US 2024/0287854 A1 Aug. 29, 2024

Related U.S. Application Data

(60) Provisional application No. 63/202,818, filed on Jun. 25, 2021.

(51) Int. Cl.
*E21B 10/573* (2006.01)
*E21B 10/60* (2006.01)

(52) U.S. Cl.
CPC ..... *E21B 10/573* (2013.01); *E21B 10/60* (2013.01)

(58) Field of Classification Search
CPC ..... E21B 10/18; E21B 10/46; E21B 10/60; E21B 10/602
See application file for complete search history.

(56) References Cited

U.S. PATENT DOCUMENTS 1,754,671 A * 4/1930 Dahl ..... E21B 10/633 175/393
2,017,834 A * 10/1935 Hummel ..... E21B 10/602 175/393
4,381,825 A * 5/1983 Radtke ..... E21B 10/61 175/393
4,567,954 A 2/1986 Voight, III
6,142,248 A * 11/2000 Thigpen ..... E21B 10/61 175/339

(Continued)

FOREIGN PATENT DOCUMENTS

CN 109973021 B * 9/2020
GB 2158101 A * 11/1985 ..... B22F 7/06
WO 2008060561 A1 5/2008

*Primary Examiner* — Jennifer H Gay
(74) *Attorney, Agent, or Firm* — Jeffrey D. Frantz

(57) ABSTRACT

A downhole tool includes a body with an interior volume and an exterior surface, a cavity in the interior volume of the body, a port located in the body, and an erosion-resistant insert. The port provides fluid communication from the cavity through the body to the exterior surface. The erosion-resistant insert is positioned in the interior volume proximate an inlet of the port, and an aperture through the erosion-resistant insert aligns with the port.

20 Claims, 8 Drawing Sheets

(56) References Cited

U.S. PATENT DOCUMENTS

| | | | | |
|---|---|---|---|---|
| 7,828,089 | B2 * | 11/2010 | Buske | E21B 10/18 76/108.2 |
| 9,234,392 | B2 * | 1/2016 | Comeau | E21B 10/38 |
| 2007/0079992 | A1 * | 4/2007 | Curry | C22C 29/08 175/374 |
| 2009/0152013 | A1 * | 6/2009 | Buske | B23K 9/048 76/108.4 |
| 2010/0193253 | A1 * | 8/2010 | Massey | E21B 17/1085 76/108.1 |
| 2013/0327575 | A1 | 12/2013 | Twardowski | |
| 2015/0129318 | A1 * | 5/2015 | Comeau | E21B 10/38 175/317 |
| 2015/0167397 | A1 | 6/2015 | Matthews, III | |
| 2018/0202233 | A1 * | 7/2018 | Cleboski | E21B 10/00 |
| 2018/0230755 | A1 | 8/2018 | Cook, III | |
| 2019/0345775 | A1 * | 11/2019 | Xu | E21B 10/602 |
| 2024/0287854 | A1 * | 8/2024 | Zhang | E21B 10/56 |

* cited by examiner

EROSION RESISTANT INSERT FOR DRILL BITS

CROSS-REFERENCE TO RELATED APPLICATIONS

This application is a National Stage Entry of International Application No. PCT/US2022/034945, filed Jun. 24, 2022, which claims the benefit of, and priority to, U.S. Patent Application No. 63/202,818 filed on Jun. 25, 2021, which is incorporated herein by this reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

During drilling of a wellbore, cutting tools including cutting elements are used to remove material from the earth to extend the wellbore or from previous casing or lining of the wellbore to change the wellbore. Drilling fluid is delivered to the cutting location through the drill pipe and through ports in the drill bit. The drilling fluid provides cooling, lubrication, and cutting evacuation. High cutting rates can require high flow rates, which produce accelerated erosion in the drill bit.

SUMMARY

In some embodiments, a downhole tool includes a body with an interior volume and an exterior surface, a cavity in the interior volume of the body, a port located in the body, and an erosion-resistant insert. The port provides fluid communication from the cavity through the body to the exterior surface. The erosion-resistant insert is positioned in the interior volume proximate an inlet of the port, and an aperture through the erosion-resistant insert aligns with the port.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure.

Understanding that the drawings depict some example embodiments, the embodiments will be described and explained with additional specificity and detail through the use of the accompanying drawings in which:

FIG. 2-1 is a bottom view of a drill bit, according to some embodiments of the present disclosure;

FIG. 2-2 is a side cross-sectional view of the drill bit of FIG. 2-1, according to some embodiments of the present disclosure;

FIG. 2-3 is a perspective cross-sectional view of the drill bit of FIG. 2-1, according to some embodiments of the present disclosure;

FIG. 3 is a top view of a drill bit with recesses, according to some embodiments of the present disclosure;

FIG. 9-1 is a side cross-sectional view of a bit body with recesses having collar portions, according to some embodiments of the present disclosure;

FIG. 9-2 is a side cross-sectional view of additively manufacturing an erosion-resistant insert in the bit body of FIG. 9-1, according to some embodiments of the present disclosure;

FIG. 10-1 is a top view of a drill bit with an erosion-resistant insert across an upward-facing surface of a cavity, according to some embodiments of the present disclosure;

FIG. 10-2 is a side cross-sectional view of the drill bit of FIG. 10-1, according to some embodiments of the present disclosure.

DETAILED DESCRIPTION

This disclosure generally relates to devices, systems, and methods for increasing operational lifetime and decreasing downtime in a drill bit. More particularly, embodiments of the present disclosure relate to devices, systems, and methods for increasing the erosion resistance of the drilling fluid ports in the drill bit.

In some embodiments, a downhole tool according to the present disclosure may have one or more drilling fluid ports and/or nozzles to deliver drilling fluid to the cutting region and remove material in a downhole environment. During cutting operations, the area at or near the cutting tool may experience high abrasion and/or erosion forces. The drilling fluid (oil-based mud or water-based mud) provides cooling, lubrication, and cutting evacuation in the cutting region. Increasing the cutting rate of the drill bit, by increasing the cutting depth or by increasing the rotation speed, can put high demands on the cutting elements and blade structure of the drill bit. Increased drilling fluid flow rate and/or pressure can provide additional cooling, lubrication, and evacuation to extend the operational lifetime of the drill bit and reduce downtime. However, in some instances, high flow rates of drilling fluid through an internal cavity of the drill bit, the ports, and/or nozzles of a drill bit can result in erosion of portions of the bit body.

Figure 1:
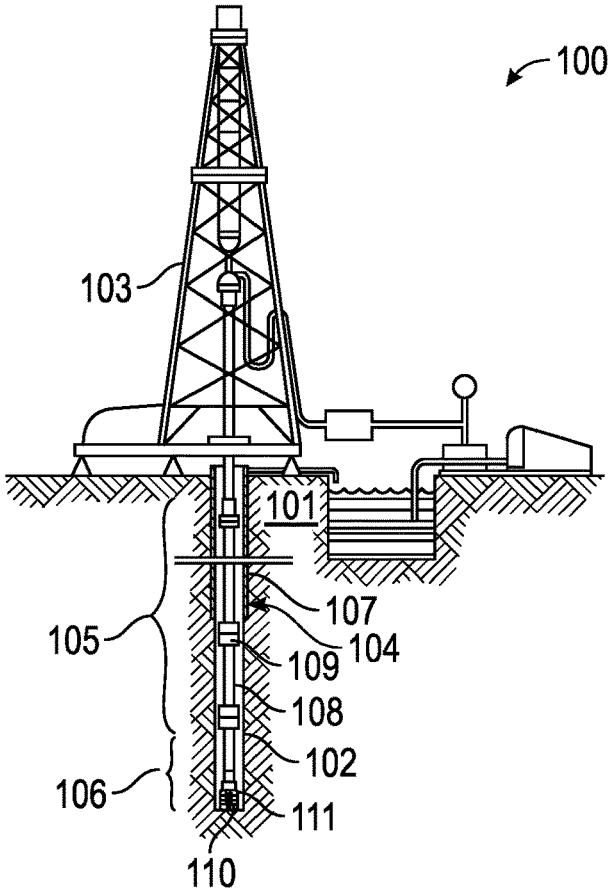
FIG. 1 is a side schematic view of a drilling system, according to some embodiments of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 a connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

Figures 1, 2:
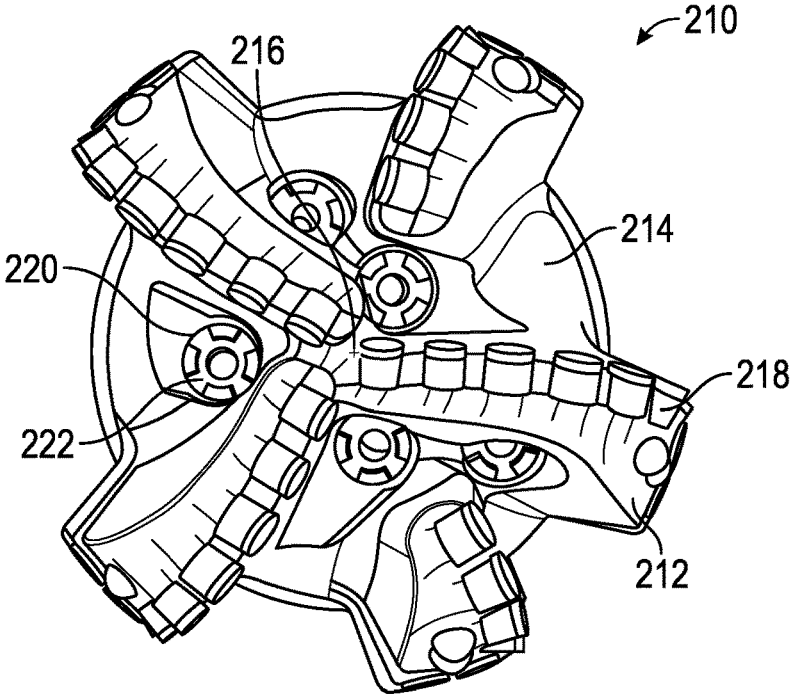
Figure 2:
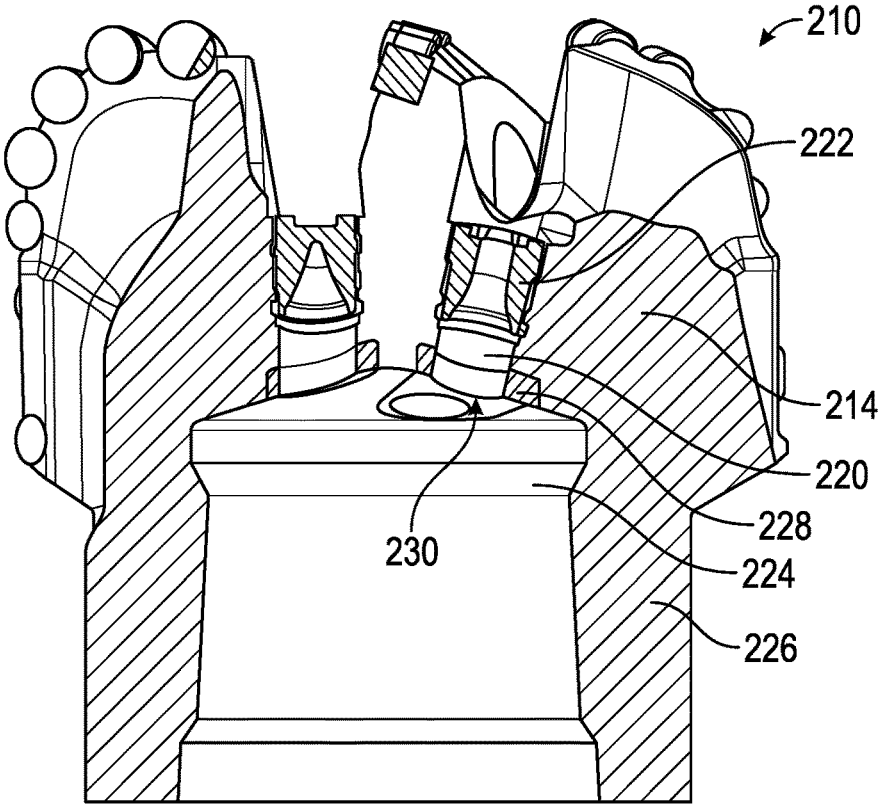

FIG. 2-1 is bottom end view of a drag drill bit 210. A drill bit 210 may, generally, include one or more blades 212 connected to a body 214. The blades 212 project from a bottom end of the body 214 such that each blade 212 has a clearance from the body 214 in a radial direction relative to a longitudinal axis 216 and clearance between the next adjacent blade 212 in a rotational direction. As the body 214 rotates about the longitudinal axis 216, cutting elements 218 positioned at the outermost edge of the blades 212 engage with the surrounding formation to fracture and remove portions of the surrounding formation to create a wellbore.

In some embodiments, the cutting elements 218 are fixed to the blade 212, and the blade 212 is fixed to the body 214, such as illustrated in FIG. 2. In some embodiments, the cutting elements are movable relative to the body, such as in a roller cone bit. A roller cone bit includes one or more roller cones connected to a body. The roller cones are rotatably connected to the bottom end of the body such that each roller cone is rotatable about a cone axis. As the body rotates about a longitudinal axis, contact between the roller cones and a formation (such as formation 101 described in relation to FIG. 1) rotates the roller cones about the cone axes. The roller cones may include a plurality of cutting elements. The cutting elements continually strike the formation as the roller cones rotate to fracture, break, degrade, or otherwise remove material from the formation to create a wellbore. While fixed-blade drag bits will be illustrated and/or described in the present disclosure, it should be understood that some aspects and features illustrated and/or described herein are equally applicable to roller cone bits, hybrid bits, or other downhole tools (e.g., reamers) including fluid ports through which drilling fluid flows.

In some embodiments, a drill bit 210 includes one or more ports 220 to allow drilling fluid to flow from an interior volume of the bit body 214 outward to the cutting region proximate the cutting elements 218. The ports 220 may include nozzles 222 positioned therein to direct or control the flow of drilling fluid through the ports 220. For example, the port 220 may be positioned between two blades 212, and the nozzle 222 may direct drilling fluid at or near one or more cutting elements 218 of the blades 212 to clear the cutting elements 218 of swarf or other debris and improve cutting efficiency. In some embodiments, the nozzles 222 are positioned in the bit body 214 from an outer surface of the bit body 214 and secured in the bit body 214 using a threaded connection and/or snap rings. In contrast, erosion-resistant inserts according to the present disclosure may be positioned on an inner surface of a cavity (as will be described in relation to FIG. 2-2) without extending through the bit body 214.

FIG. 2-2 is a side cross-sectional view of the drill bit 210 of FIG. 2-1. The ports 220 provide a fluid path from a cavity 224 inside the bit body 214 through the exterior surface of the bit body 214. The cavity 224 may be a plenum configured to receive a fluid from the drill string coupled to the drill bit 210 for distribution through the drill bit 210. In some embodiments, the drill bit 210 and/or bit body 214 includes a box 226 that allows the drill bit 210 to be mated to a pin of the drill string. In some embodiments, the box 226 includes interior threads to mate the drill bit 210 to a downhole tool or drill pipe with external threads on a pin. In particular examples, the box 226 may be relatively short, such as in a steerable drill bit 210. A short box 226 may be more susceptible to the formation of drilling fluid eddies and/or small radius turns in flow direction, causing the short box 226 and/or drill bit 210 to be more susceptible to erosion. In some embodiments, the drill bit 210 and/or bit body 214 includes a pin with external threads that allows the drill bit 210 to mate to a downhole tool or drill pipe with internal threads on a box.

The flow of drilling fluid through the drill string to the drill bit accelerates through the ports 220 and past the nozzles 222. The high flowrate of the drilling fluid through ports 220 and/or the eddies formed at or near the ports 220 in the cavity 224 may cause erosion of the bit body 214 proximate the port 220. In some embodiments according to the present disclosure, a drill bit 210 includes erosion-resistant inserts 228 positioned circumferentially around an inlet 230 of at least one port 220.

The erosion-resistant insert 228 includes at least one erosion-resistant working material. The working material may be a metal, a metal alloy, a carbide, a non-metal, a crystalline material, an amorphous material, or combinations thereof. In some embodiments, the working material has a bulk hardness greater than a body material of the bit body 214 immediately adjacent to the erosion-resistant insert 228 on the inner surface 225 of the cavity 224. For example, the working material may be a dual phase material with particles supported in a matrix, such as a metal-matrix carbide. The bulk hardness is determined by the hardness of the overall material and not the individual phases of the working material. In at least one example, the bit body material is steel alloy and the working material is tungsten carbide. A steel bit body may have the recesses machined therein. In at least one example, the bit body material is a matrix material, and the recesses are formed in the bit body during manufacturing or machined therein after. The working material may have a higher tungsten carbide content than a matrix bit body.

In some embodiments, the working material is or includes an ultrahard material. For example, the working material may include a ceramic, carbide, diamond, or ultrahard material. An ultrahard material is understood to refer to those materials known in the art to have a grain hardness of about 1,500 HV (Vickers hardness in kg/mm2) or greater. Such ultrahard materials can include but are not limited to diamond or polycrystalline diamond (PCD), nanopolycrystalline diamond (NPD), or hexagonal diamond (Lonsdaleite); cubic boron nitride (cBN); polycrystalline cBN (PcBN); Q-carbon; binderless PcBN; diamond-like carbon; boron suboxide; aluminum manganese boride; metal borides; boron carbon nitride; and other materials in the boron-nitrogen-carbon-oxygen system which have shown hardness values above 1,500 HV, as well as combinations of the above materials. It could also be composed of Tungsten carbide, Titanium carbide, or any carbide family or any material matrix system including these hard carbides and a softer binder. In at least one embodiment, a portion of the erosion-resistant insert 228 may be a monolithic carbonate PCD. For example, a portion of the erosion-resistant insert 228 may consist of a PCD without an attached substrate or metal catalyst phase. In some embodiments, the ultrahard material may have a hardness values above 3,000 HV. In other embodiments, the ultrahard material may have a hardness value above 4,000 HV. In yet other embodiments, the ultrahard material may have a hardness value greater than 80 HRa (Rockwell hardness A).

Figures 2, 3:
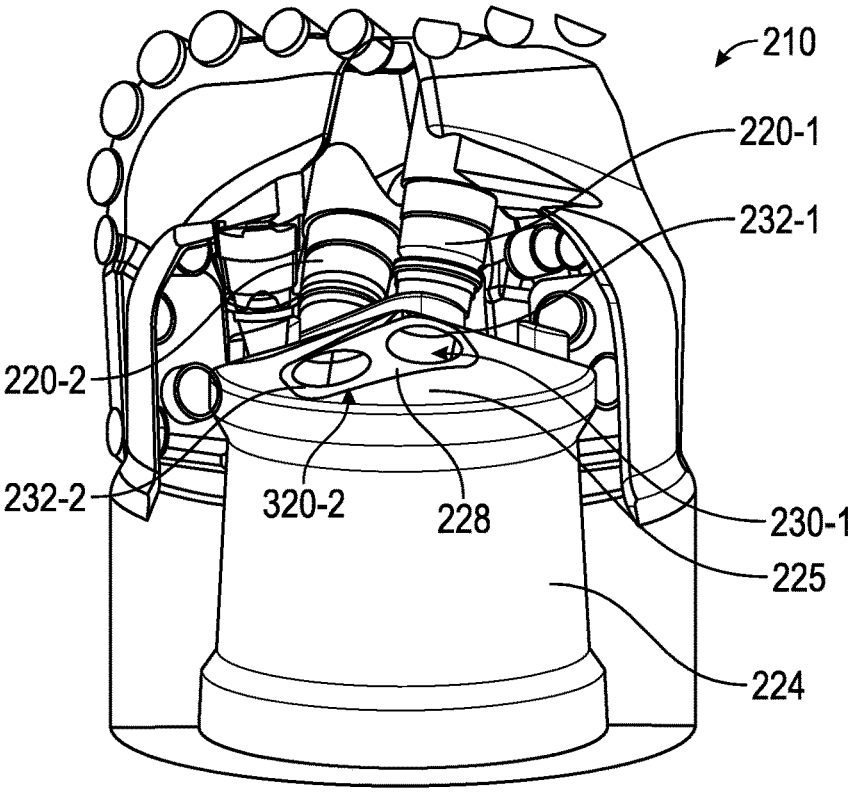
Figure 3:
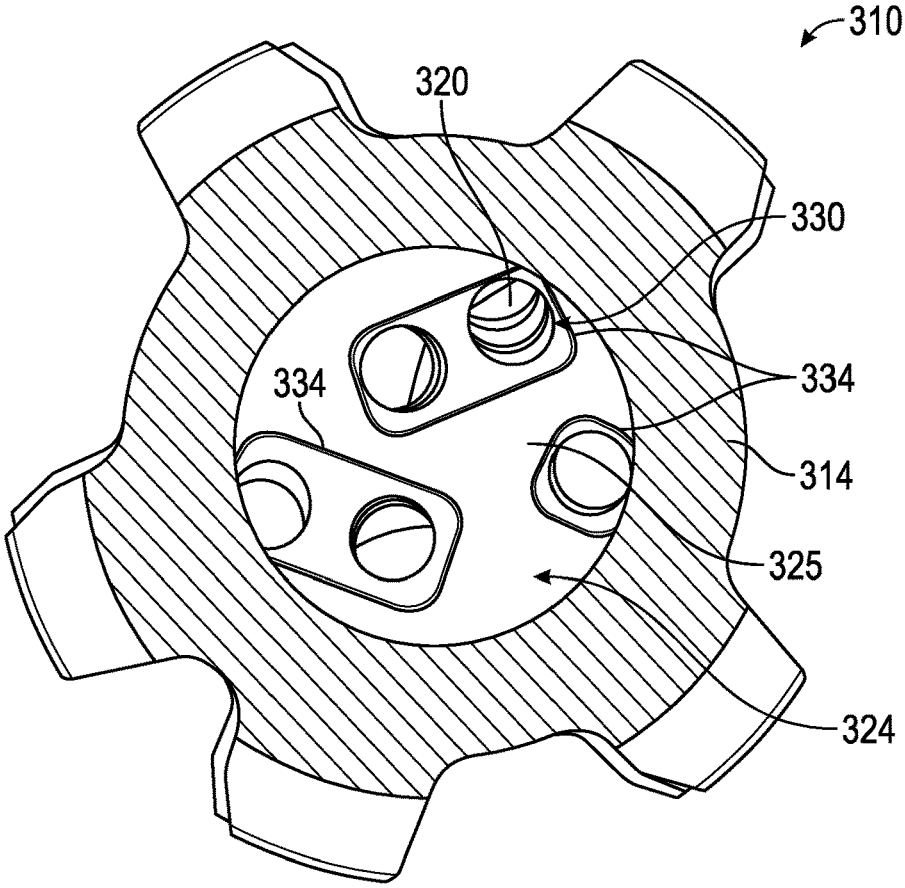

FIG. 2-3 is a perspective view of the cross-section of the drill bit 210 of FIG. 2-1 and FIG. 2-2. In some embodiments, the erosion-resistant insert 228 is inserted into a recess in the surface of the cavity 224. For example, the erosion-resistant insert 228 positioned in the recess may fill the recess such that the erosion-resistant insert 228 creates a substantially continuous surface with the inner surface of the cavity 224.

The erosion-resistant insert 228 limits and/or prevents the erosion of material around the port(s) 220 of the drill bit 210 to extend the operational lifetime of the drill bit 210 during downhole operations. In some embodiments, the erosion-resistant insert 228 circumferentially surrounds the inlet(s) 230-1, 230-2 of the port(s) 220-1, 220-2. The erosion-resistant insert 228 may, thereby, protect the region of the bit body 214 that is eroded fastest by the drilling fluid.

The aperture(s) 232-1, 232-2 in the erosion-resistant insert 228 may be sized and/or positioned to minimize erosion of the port(s) 220-1, 220-2. For example, a first aperture 232-1 may be aligned with a first inlet 230-1 of a first port 220-1. The first aperture 232-1 may be aligned with the first inlet 230-1 when the first aperture 232-1 is the same area as the first inlet 230-1, in the same position as the first inlet 230-1, the same shape as the first inlet 230-1, or combinations thereof. In at least one example, the first aperture 232-1 is aligned with the first inlet 230-1 when the first aperture 232-1 is the same area as the first inlet 230-1, in the same position as the first inlet 230-1, and the same shape as the first inlet 230-1. In some embodiments, an erosion-resistant insert 228 has a first aperture 232-1 that aligns with a first inlet 230-1, and the erosion-resistant insert 228 has a second aperture 232-2 that aligns with a second inlet 230-2.

FIG. 3 is a top view of an embodiment of a drill bit 310 with recesses 334 formed therein to accept erosion-resistant inserts. In some embodiments, a recess 334 is positioned in an inner surface 325 of the cavity 324 around a single port 320. In some embodiments, the recess(es) 334 are positioned on the upward facing surface of the inner surface 325 and not the circumferential surface (e.g., proximate the gauge surfaces of the drill bit 310). As discussed herein, the term "upward facing surface" refers to the portion of the inner surface that faces uphole toward the connection (e.g., box, pin) of the drill bit 310. In some embodiments, a recess 334 is positioned around a plurality of ports 320. The erosion-resistant insert may be manufactured separately from the bit body 314 and subsequently inserted into and affixed to the bit body 314. For example, different erosion-resistant inserts, such as having different geometries or made of different working materials, may be selected depending on the drilling fluid and/or flowrates intended for a drilling operation. In operations with lower drilling fluid flowrates and/or shorter operational durations, a cheaper erosion-resistant insert may be used. In more demanding drilling operations, a harder and/or stronger erosion-resistant insert may be selected.

Figure 4:
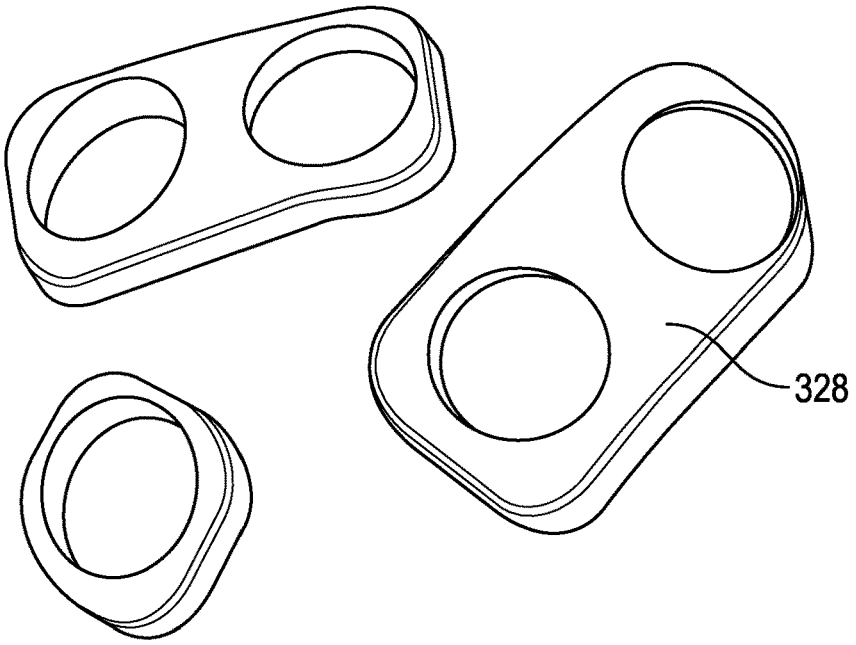
FIG. 4 is a perspective view of a plurality of erosion-resistant inserts, according to some embodiments of the present disclosure.

FIG. 4 illustrates erosion-resistant inserts 328 configured to fit in the recesses 334 described in relation to FIG. 3. In some embodiments, an erosion-resistant insert 328 is cast in a final form for application into a bit body. In some embodiments, an erosion-resistant insert 328 is cast into a near-final form and machined to the final form. In some embodiments, an erosion-resistant insert 328 is cast in a green state and formed to the final form. In some embodiments, an erosion-resistant insert 328 is machined from a billet of working material. In some embodiments, an erosion-resistant insert 328 is additively manufactured to the final form or near-final form. Additive manufacturing may provide a consistent and controlled microstructure that is more homogeneous than casting. In some embodiments, the working material may be an expensive part of the drill bit. Additive manufacturing of the erosion-resistant insert 328 may reduce waste, which may reduce costs for the working material. In some embodiments, additive manufacturing may also allow additional erosion-resistant inserts 328 to be produced in the field. An erosion-resistant insert 328 may be pre-manufactured and affixed to the bit body.

Figure 5:
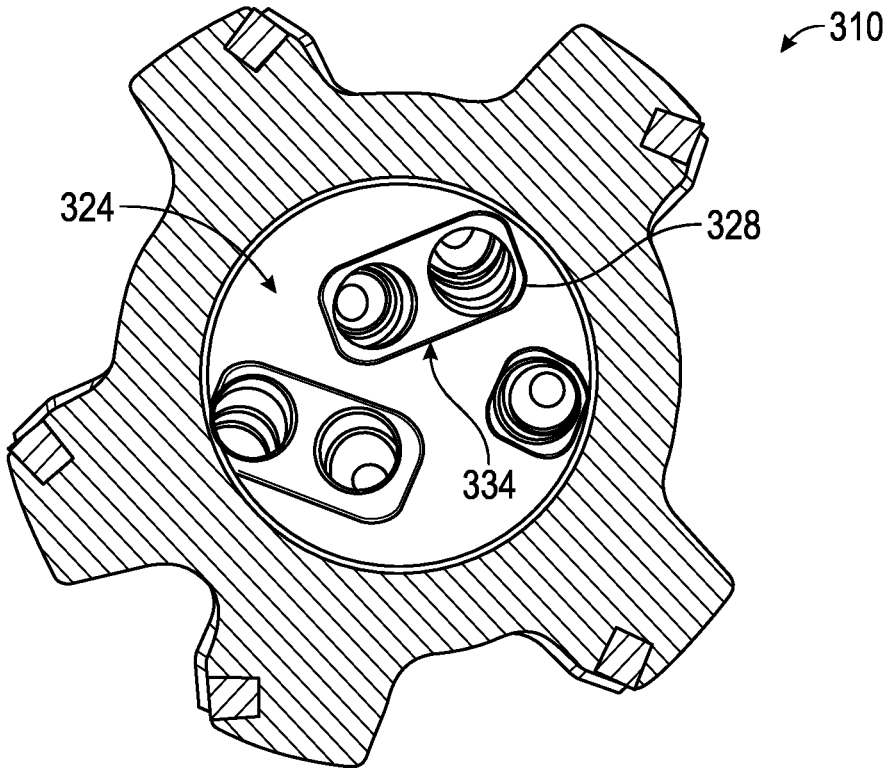
FIG. 5 is a top view of a drill bit with erosion-resistant inserts, according to some embodiments of the present disclosure.

FIG. 5 is a top section view of the embodiment of a drill bit 310 with erosion-resistant inserts 328 positioned in the recesses 334. In some embodiments, an erosion-resistant insert 328 is fixed in the recess 334 with an adhesive. For example, the erosion-resistant insert 328 may be fixed in the recess 334 with an epoxy adhesive.

During drilling operations, including positioning of the bit in the wellbore without actively cutting, drill bit 310 experiences vibration and shock. In some embodiments, the fluid pressure inside the cavity 324 may apply a force to the erosion-resistant insert 328 to maintain the erosion-resistant insert 328 in the recess 334 during drilling operations.

Some embodiments of a drill bit 310 may retain the erosion-resistant insert 328 in the recess 334 using additional or alternative retention mechanisms. For example, the erosion-resistant insert 328 may be press fit or friction fit into the recess 324 in addition to or in alternative to the other retention mechanisms described herein. For example, an adhesive may be positioned in the recess 334 prior to press fitting the erosion-resistant insert 328 in the recess 334. In some embodiments, the press fit may compress opposing lateral sides of the erosion-resistant insert 328 while allowing a gap or tolerance in the orthogonal sides to permit the adhesive to flow around the erosion-resistant insert 328. For example, the erosion-resistant insert 328 may be smaller than the recess 334 in at least one direction. In some embodiments, the erosion-resistant insert 328 may elastically deform it at least one direction and engage with a profile of the recess 334, similar to a snap ring. For example, the erosion-resistant insert 328 may elastically compress to seat into the recess and at least partially elastically restore toward an original state to engage with a profile of the recess 334 and retain the erosion-resistant insert 328 in the recess 334. In some examples, the erosion-resistant insert 328 may fully elastically restore once seated in the recess 334. In some examples, the erosion-resistant insert 328 may partially elastically restore and apply a force to the sides of the recess 334 once seated in the recess 334. In some embodiments, a seal may be arranged between the erosion-resistant insert 328 and the drill bit 310. For example, the seal may be an elastomeric ring.

Figure 6:
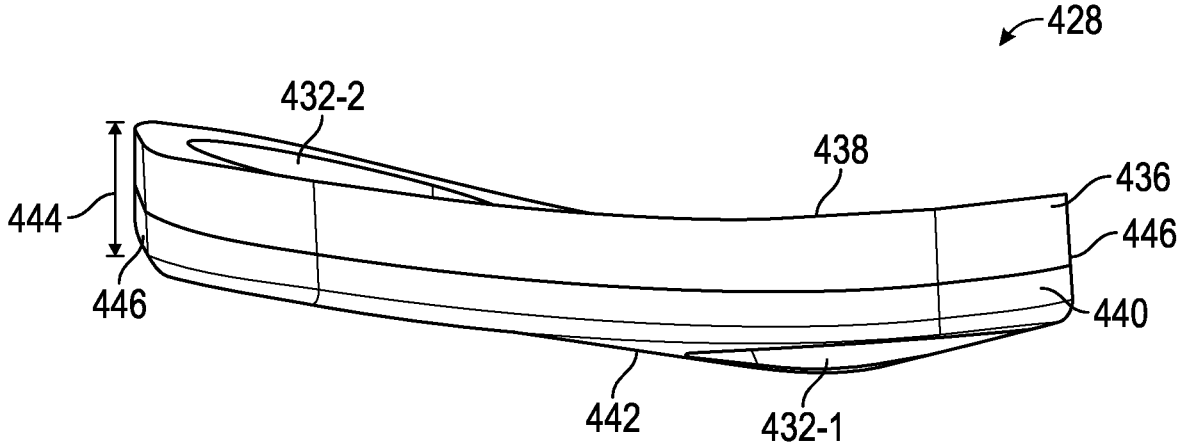
FIG. 6 is a side view of an erosion-resistant insert, according to some embodiments of the present disclosure.

FIG. 6 is a side view of an embodiment of an erosion-resistant insert 428. In some embodiments, the erosion-resistant insert 428 is brazed into the recess (such as recess 334 described in relation to FIG. 5). Brazing can provide a strong and resilient connection between the erosion-resistant insert 428 and the bit body using an intermediate layer of brazing material. However, some materials are more compatible with brazing than others. For example, the brazing process exposes the materials to high heat which may damage certain materials. In some examples, the brazing process requires the wetting of brazing material into surface features and/or voids of one or both materials being brazed together.

In some embodiments, the erosion-resistant insert 428 includes a plurality of materials with different properties. In some examples, a working material 436 is positioned on a wear surface 438, which is the surface exposed to the cavity and drilling fluid during drilling operations. The working material 436 may be any working material described herein. The working material 436 may be bonded to a contact material 440 that is positioned proximate the contact surface 442 of the erosion-resistant insert 428. The contact surface 442 is the surface proximate to and/or contacting the bit body when the erosion-resistant insert 428 is installed in the drill bit. It should be understood that the erosion-resistant insert 428 has a contact surface 442 whether or not the erosion-resistant insert 428 includes a contact material 440 that is different than the working material 436. For example, an erosion-resistant insert 428 including only a working material 436 has a contact surface 442 of the working material 436.

The working material 436 and the contact material 440 may be cast together during manufacturing of the erosion-resistant insert 428. The working material 436 and the contact material 440 may be cast or sintered into a billet that is subsequently machined to final or near-final form. In some embodiments, the working material 436 and contact material 440 are bonded using an intermediate or interstitial binder therebetween. In at least one embodiment, the working material 436 is additively manufactured upon a substrate of the contact material 440, or the contact material 440 is additively manufactured upon a substrate of the working material 436.

In some embodiments, the thickness is at least partially related to the working material strength and erosion resistance. In some embodiments, the thickness is greater than 0.040". In some embodiments, the thickness is between 0.060" to 0.500". In some embodiments, the thickness is between 0.090" to 0.380".

In some embodiments, the erosion-resistant insert 428 is contoured to complementarily follow the inner surface of the cavity of the drill bit. Whether at least a portion of the working surface 438 and/or contact surface 442 is curved, planar, or both, in some embodiments, the thickness 444 of the erosion-resistant insert 428 is substantially constant between the working surface 438 and the contact surface 442. In some embodiments in which the working surface 438 is curved, the sidewalls 446 of the erosion-resistant insert 428 are parallel to one another to allow the insertion of the erosion-resistant insert 428 into the recess. The erosion-resistant insert 428 may be tapered from the cavity toward the port, thereby facilitating insertion of the erosion-resistant insert 428 into the recess.

Whether at least a portion of the working surface 438 and/or contact surface 442 is curved, planar, or both, in some embodiments, the thickness 444 of the erosion-resistant insert 428 between the working surface 438 and the contact surface 442 varies across the face of the erosion-resistant insert 428. For example, the erosion-resistant insert 428 may taper in thickness 444 toward the sidewalls 446, as the erosive forces are greatest proximate the aperture(s) 432-1, 432-2. In another example, the erosion-resistant insert 428 may be greater in thickness 444 proximate the apertures 432-1, 432-2 and taper in thickness between the apertures 432-1, 432-2.

Figure 7:
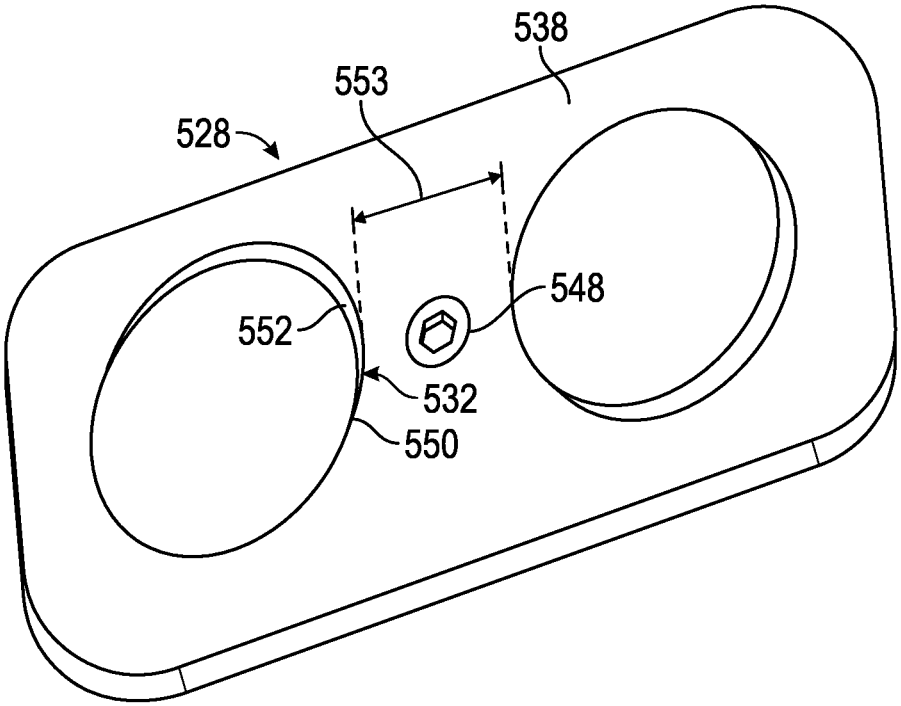
FIG. 7 is a top view of another erosion-resistant insert, according to some embodiments of the present disclosure.

FIG. 7 is a top view of another embodiment of an erosion-resistant insert 528 according to the present disclosure. In some embodiments, a retention mechanism for retaining the erosion-resistant insert 528 in the recess is a mechanical fastener. For example, one or more mechanical fasteners 548, such as a bolt, a screw, a clip, a clamp, a pin, a threaded rod, a rivet, or other mechanical fastener (removable or non-removable) may contact both the erosion-resistant insert 528 and the bit body to secure the erosion-resistant insert 528 in the recess. As described herein, a combination of retention mechanisms may be used to retain the erosion-resistant insert 528 in the recess. For example, a mechanical fastener 548 may secure the erosion-resistant insert 528 in the recess to aid in brazing or adhering the erosion-resistant insert 528 in the recess. In another example, a mechanical fastener 548, such as a screw or bolt, may assist in applying a compressive force to press fit the erosion-resistant insert 528 into the recess.

The embodiment of a mechanical fastener 548 illustrated in FIG. 7 is positioned in an approximate center of the erosion-resistant insert 528. In some embodiments, the mechanical fastener(s) 548 may be positioned in other locations in the erosion-resistant insert 528, for example, to limit erosion of the mechanical fastener 548. The mechanical fastener 548 may include or be made of a less erosion-resistant material than the erosion-resistant insert 528 and, therefore, be prone to eroding before the erosion-resistant insert 528. The mechanical fastener 548 may be positioned away from the aperture(s) 532 to limit the erosion of the mechanical fastener 548. A head of the mechanical fastener 548 may include an engagement feature to allow a driver to torque the mechanical fastener 548. The engagement feature, such as a hex head, a Philips head relief, a slot, etc., may be prone to erosion. A cover or additional material, such as working material or hardfacing material, may be positioned over the head of the mechanical fastener 548 to limit and/or prevent erosion of the mechanical fastener 548.

As shown in FIG. 7, in some embodiments, an erosion-resistant insert 528 has an aperture 532 with a working edge 550 (e.g., proximate the working surface 538) that is discontinuous from the working surface 538. For example, the working edge 550 may be a discontinuous 90° angle between the working surface 538 and the aperture wall 552. In other examples, the working edge 550 may be a discontinuous edge that has another angle between the working surface 538 and the aperture wall 552.

In some embodiments, the working edge 550 is radiused or continuous between the working surface 538 and the aperture wall 552. In at least one embodiment, a radiused or continuous working edge 550 between the working surface 538 and the aperture wall 552 reduces turbulent flow in the aperture 532 and/or into the inlet of the port (e.g., inlet 230 and port 220 described in relation to FIG. 2-1 through 2-3). Reducing the turbulent flow may reduce erosion on the erosion-resistant insert 528, the port, the nozzle, or other components of the drill bit.

At least a portion of the working edge 550 has a radius between the working surface 538 and the aperture wall 552, in some embodiments, in a range having an upper value, a lower value, or upper and lower values including any of 0.5 mm, 1.0 mm, 2.0 mm, 3.0 mm, 4.0 mm, 5.0 mm, or any values therebetween. For example, at least a portion of the working edge 550 may have a radius greater than 0.5 mm. In some examples, at least a portion of the working edge 550 has a radius less than 5.0 mm. In some examples, the radius may vary, but be within 0.5 mm and 5.0 mm for the entire working edge 550 of an aperture 532.

In some embodiments, a spacing 553 between the apertures 532 is in a range having an upper value, a lower value, or upper and lower values including any of 0.5 mm, 1.0 mm, 2.0 mm, 3.0 mm, 4.0 mm, 5.0 mm, or any values therebetween. For example, at least a portion of the working edge 550 may have a radius greater than 0.5 mm. In some examples, the spacing 553 may be less than 5.0 mm. In some examples, the spacing 553 may be greater than 1.0 mm. In some examples, the spacing 553 may be between 1.0 mm and 3.0 mm.

Figure 8:
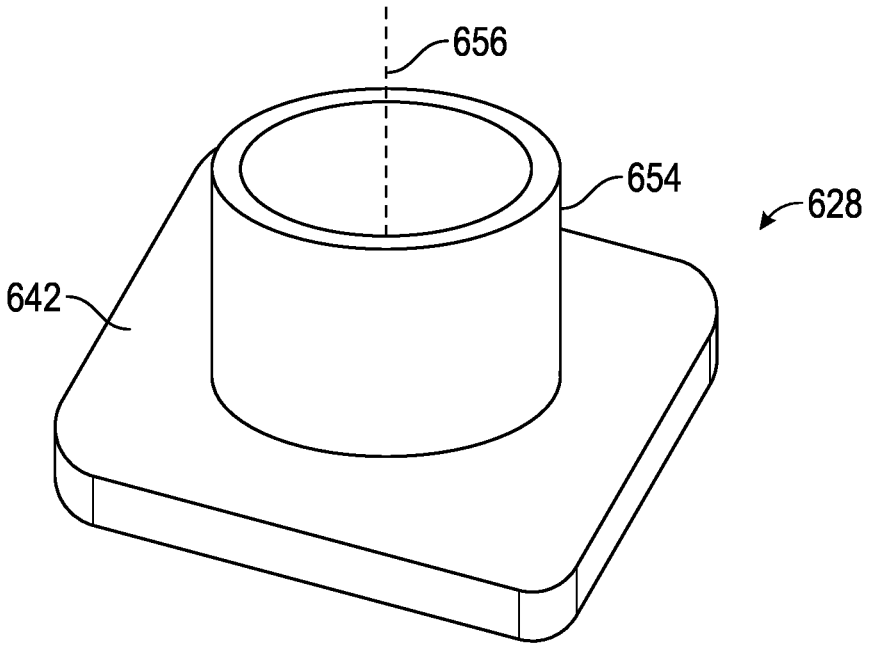
FIG. 8 is a perspective view of yet another erosion-resistant insert, according to some embodiments of the present disclosure.

Referring now to FIG. 8, some embodiments of erosion-resistant inserts 628 included a collar 654 that is configured to extend into the port (such as port 220 described in relation to FIG. 2-1 through FIG. 2-3). The collar 654 may provide additional contact surface 642 (whether the erosion-resistant insert 628 includes a contact material or not) with which the erosion-resistant insert 628 contacts the bit body. In some embodiments, the additional area of contact surface 642 allows for greater friction between the erosion-resistant insert 628 and the surface(s) of the recess. In some embodiments, the additional area of contact surface 642 allows for a larger contact patch for adhesive or brazing between the erosion-resistant insert 628 and the surface(s) of the recess. In some embodiments, the collar 654 may limit the erosion of the port due to drilling fluid, which could otherwise scour behind the erosion-resistant insert 628 and between the erosion-resistant insert 628 and the bit body. Additionally, or in the alternative, a seal between the erosion-resistant insert 628 and the bit body may reduce or eliminate erosion of the port.

The collar 654 has a collar axis 656. In at least one example, the collar axis 656 is non-perpendicular to the contact surface 642 of the erosion-resistant insert 628. The collar 654 may assist in directing the drilling fluid into the port in the direction of the collar axis 656. In at least one embodiment, the collar axis 656 is aligned with an axis of the associated port in which the collar 654 is positioned.

An erosion-resistant insert 628 with a collar 654 may be pre-manufactured through any manufacturing process described herein and fixed in a recess of a bit body. In some embodiments, an erosion-resistant insert 628 is additively manufactured in situ in the bit body. For example, in situ additive manufacturing may allow the working material or contact material of the erosion-resistant insert 628 to bond directly to the bit body material at a microstructural level. In at least one example, a tungsten carbide working material may bond directly to a tungsten bit body material, integrally forming the insert with the bit body. In some embodiments, the erosion-resistant insert 628 includes a mechanical interlock with the bit body 614 to hold the erosion-resistant insert 628 in the recess 634. In some embodiments, in situ additive manufacturing may allow the working material of the erosion-resistant insert 628 to have geometries and/or mechanical interlocks with the bit body that are not possible to achieve with a pre-manufactured erosion-resistant insert 628. For example, some geometries or shapes of erosion-resistant inserts 628 may not be possible to insert into the recess in a final form. Some geometries or shapes of erosion-resistant inserts 628 may not be possible to remove from the cavity of the bit body in a final form without removal of portions of the drill bit or the erosion-resistant insert 628.

Figures 1, 9:
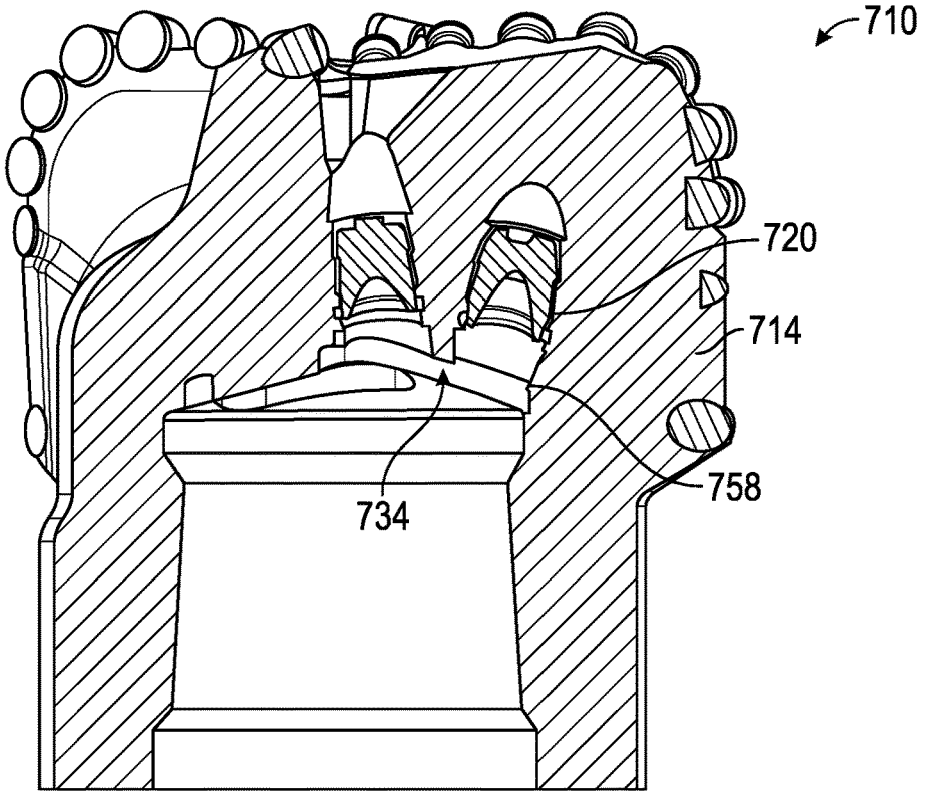
Figures 2, 9:
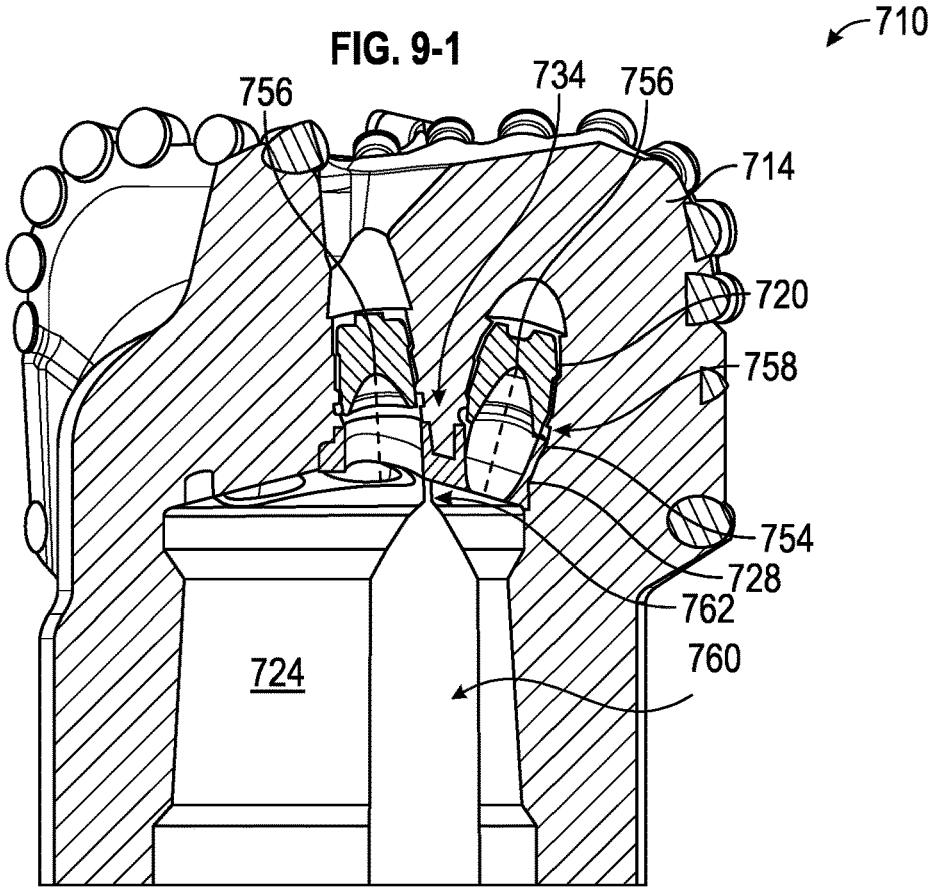

FIG. 9-1 and FIG. 9-2 illustrate an example of in situ additive manufacturing of an erosion-resistant insert in a drill bit 710. In some embodiments, an erosion-resistant insert has a geometry or shape that prevents the erosion-resistant insert from moving relative to the bit body once positioned in the recess. The recess 734 may have a complementary shape that receives the erosion-resistant insert and retains the erosion-resistant insert through a mechanical interlock between a portion of the bit body and at least a portion of the erosion-resistant insert. In some embodiments, the recess 734 may span across a plurality of ports 720 in the bit body 714.

In examples of a recess configured to receive an erosion-resistant insert with one or more collars, the recess 734 may include a collar portion 758 extending into one or more ports 720 of the bit body 714. In some embodiments, the collar portion 758 has a length that is less than a full length of the port 720. In some embodiments, the collar portion 758 has a length that is less than half of the full length of the port 720. In some embodiments, the collar portion 758 has a length that is less than one-quarter of the full length of the port 720. In embodiments of a drill bit 710, such as shown in FIG. 9-1, where the ports 720 are oriented in different directions, an in situ additively manufactured erosion-resistant insert may have collars with collar axes in different directions, which may prohibit the insertion of the erosion-resistant insert after manufacturing.

FIG. 9-2 illustrates in situ additive manufacturing of an erosion-resistant insert 728 in the recess 734 of the drill bit 710 described in relation to FIG. 9-1. The recess has a plurality of collar portions 758, and the erosion-resistant insert 728, when additively manufactured in the recess 734, has complementary collars 754. The additive manufacturing system 760 deposits layers of working material and/or contact material to build up the erosion-resistant insert 728 in situ through a deposition tip 762. In some embodiments, the additive manufacturing system 760 is located on a multi-axis support or stage that allows 2-, 3-, 4-, 5-, or 6-axis control of the deposition tip 762.

The deposition tip 762 of the additive manufacturing system 760 may be positioned in the cavity 724 of the drill bit 710 to print the erosion-resistant insert 728. The additive manufacturing system 760 can print the erosion-resistant insert 728 including the collars 754 having non-parallel collar axes 756. Upon hardening and/or curing of the erosion-resistant insert 728, the erosion-resistant insert 728 becomes mechanically interlocked with the bit body 714 to secure the erosion-resistant insert 728 in the recess 734. Yet the whole process could also be manually operated, for example a manual torch operation to heat and spray erosion-resistant material onto the recess 734.

Figures 1, 10:
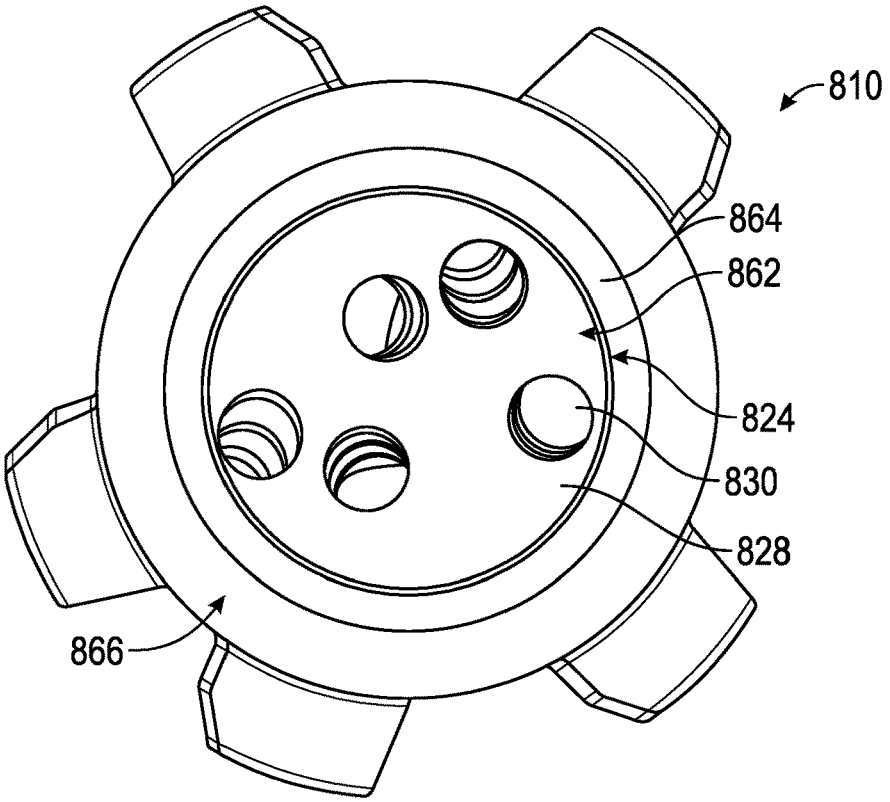
Figures 2, 10:
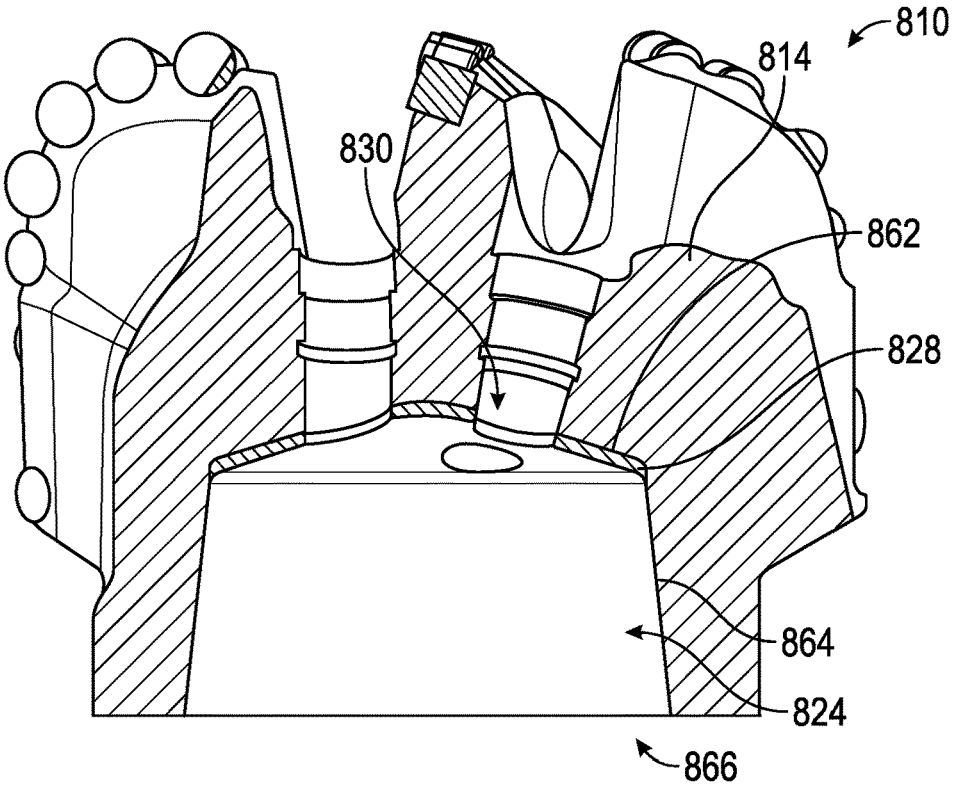

In some embodiments, the erosion-resistant insert covers at least 50% of, or the entire, upward-facing surface of the cavity. FIGS. 10-1 and 10-2 illustrate an embodiment of a drill bit 810 with an erosion-resistant insert 828 that covers and protects the entire upward-facing surface 862 of the cavity 824. In some embodiments, the erosion-resistant insert 828 is continuous across the entire upward-facing surface 862 of the cavity 824. For example, the erosion-resistant insert 828 may be manufactured to complementarily mate with the upward-facing surface 862 of the cavity 824 and, in some embodiments, at least a portion of the side surfaces of the cavity 824. In some embodiments, the upward-facing surface 862 has a recess for the erosion-resistant insert 828. In some embodiments, the side surface 864 of the cavity 824 and/or entrance 866 to the box or pin of the drill bit 810 may flare to allow a pre-manufactured erosion-resistant insert 828 to be positioned in the cavity 824. In some embodiments, the erosion-resistant insert 828 is larger in one or more dimensions than an entrance 866 to the cavity through the box or pin of the drill bit 810. In some examples, the erosion-resistant insert 828 may be additively manufactured in situ to cover the upward-facing surface 862. The erosion-resistant insert 828 is therefore a single continuous piece of working material (and, optionally, contact material) that protects the inlets 830 and surrounding surface of the cavity 824 of the bit body 814 from erosion.

Figure 11:
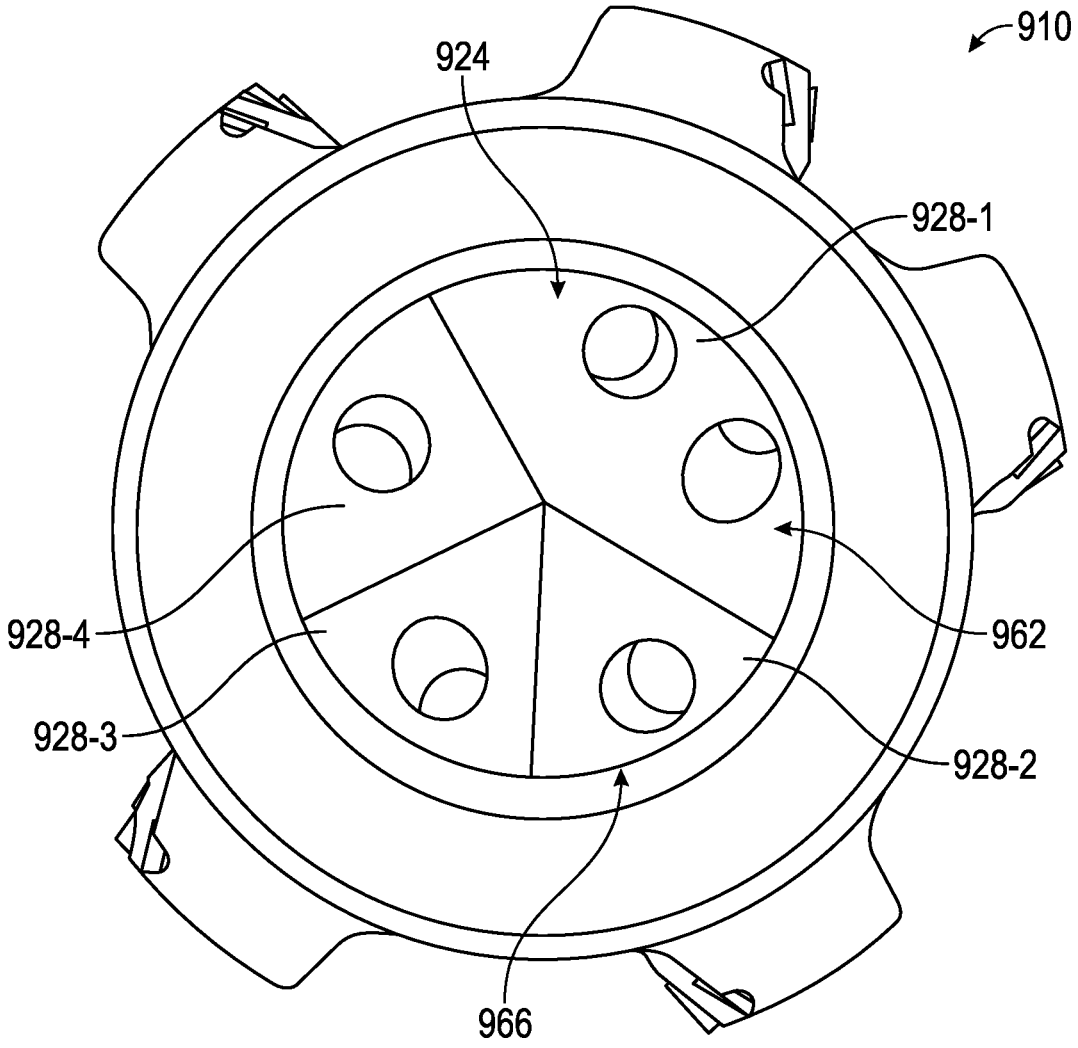
FIG. 11 is a top view of a drill bit with a plurality of erosion-resistant inserts across an upward-facing surface of a cavity, according to some embodiments of the present disclosure.

FIG. 11 is a top view of another embodiment of a drill bit 910 with a plurality of erosion-resistant inserts 928-1, 928-2, 928-3, 928-4 in the cavity 924 that, when positioned in the cavity 924 cover substantially the entire upward-facing surface 962 of the cavity 924. In some embodiments, each of the erosion-resistant inserts 928-1, 928-2, 928-3, 928-4 is smaller than the entrance 966 to the cavity 924 through the box or pin of the drill bit 910, allowing the individual erosion-resistant inserts 928-1, 928-2, 928-3, 928-4 to be inserted through the entrance 966, positioned in the cavity 924, and arranged to cover substantially the entire upward-facing surface 962 of the cavity 924. In some embodiments, one or more recesses of the upward-facing surface of the cavity 924 may be configured to receive the erosion-resistant inserts 928. In some embodiments, the erosion-resistant inserts 928 may interlock or interconnect with one another or with features of the drill bit 910 within the cavity 924. For example, a collar of the erosion-resistant insert 928-2 may be configured for partial insertion with a port of the drill bit 910, thereby retaining the erosion-resistant insert 928-2 at a desired position. Additionally or in the alternative, interconnection of the erosion-resistant inserts 928 together enable formation of an erosion-resistant insert assembly that is larger than the entrance 966 to the cavity 924.

The individual erosion-resistant inserts 928-1, 928-2, 928-3, 928-4 may have an equal size to each other. In other examples, the erosion-resistant inserts 928-1, 928-2, 928-3, 928-4 may have different sizes to one another, such as illustrated in the embodiment of FIG. 11. In some examples, the erosion-resistant inserts 928-1, 928-2, 928-3, 928-4 are wedges around a center axis. In other examples, the erosion-resistant inserts 928-1, 928-2, 928-3, 928-4 may have any shape small enough to fit through the entrance 966 to the cavity 924. In some embodiments, the erosion-resistant inserts 928-1, 928-2, 928-3, 928-4 may be spaced apart from one another within the cavity, such as arranged within respective recesses.

The embodiments of cutting tools have been primarily described with reference to wellbore cutting operations; the cutting tools described herein may be used in applications other than the drilling of a wellbore. In other embodiments, cutting tools according to the present disclosure may be used outside a wellbore or other downhole environment used for the exploration or production of natural resources. For instance, cutting tools of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A downhole tool, the downhole tool comprising:
- a body having an interior volume and an exterior surface;
- a cavity located in the interior volume of the body;
- a first port located in the body, the first port providing fluid communication from the cavity through the body to the exterior surface;
- a second port located in the body, the second port providing fluid communication from the cavity through the body to the exterior surface; and
- a pre-manufactured erosion-resistant insert positioned in the interior volume proximate an inlet of the first port and an inlet of the second port, wherein a first aperture through the erosion-resistant insert aligns with the first port, and a second aperture through the erosion-resistant insert aligns with the second port.

2. The downhole tool of claim 1, wherein the pre-manufactured erosion-resistant insert is additively manufactured.

3. The downhole tool of claim 1, wherein the pre-manufactured erosion-resistant insert has a bulk hardness greater than a bit body material.

4. The downhole tool of claim 1, wherein the pre-manufactured erosion-resistant insert comprises tungsten carbide.

5. The downhole tool of claim 1, wherein the pre-manufactured erosion-resistant insert comprises an ultrahard material.

6. The downhole tool of claim 1, wherein at least one of the first port or the second port comprises a drilling fluid nozzle.

7. The downhole tool of claim 1, wherein the pre-manufactured erosion-resistant insert is brazed to the body.

8. The downhole tool of claim 1, wherein the pre-manufactured erosion-resistant insert comprises a collar positioned in the first port or the second port.

9. The downhole tool of claim 1, wherein the pre-manufactured erosion-resistant insert comprises a first collar positioned in the first port and a second collar positioned in the second port.

10. The downhole tool of claim 9, wherein the first collar has a first collar axis and the second collar has a second collar axis, and the first collar axis is not parallel to the second collar axis.

11. The downhole tool of claim 1, wherein a working material of the pre-manufactured erosion-resistant insert is microstructurally bonded directly to the body.

12. The downhole tool of claim 1, wherein the first aperture is the same area as the inlet of the first port, in the same position as the inlet of the first port, and the same shape as the inlet of the first port.

13. The downhole tool of claim 1, wherein the body comprises a recess in a surface of the cavity and the pre-manufactured erosion-resistant insert is positioned in the recess.

14. The downhole tool of claim 1, wherein the pre-manufactured erosion-resistant insert comprises a first layer of working material and a second layer of contact material, the working material and the contact material being different.

15. A downhole tool, the downhole tool comprising:
- a body having an interior volume and an exterior surface;
- a cavity located in the interior volume of the body;
- a port located in the body, the port providing fluid communication from the cavity through the body to the exterior surface; and
- a pre-manufactured erosion-resistant insert positioned in the interior volume proximate an inlet of the port, wherein an aperture through the erosion-resistant insert aligns with the port, and wherein the pre-manufactured erosion-resistant insert is brazed to the body.

16. The downhole tool of claim 15, wherein the body comprises a recess in a surface of the cavity and the pre-manufactured erosion-resistant insert is positioned in the recess.

17. The downhole tool of claim 15, wherein the pre-manufactured erosion-resistant insert comprises a collar positioned in the port.

18. A downhole tool, the downhole tool comprising:
- a body having an interior volume and an exterior surface;
- a cavity located in the interior volume of the body;
- a port located in the body, the port providing fluid communication from the cavity through the body to the exterior surface; and
- a pre-manufactured erosion-resistant insert positioned in the interior volume proximate an inlet of the port, wherein an aperture through the erosion-resistant insert aligns with the port, and wherein the pre-manufactured erosion-resistant insert comprises a first layer of working material and a second layer of contact material, the working material and the contact material being different.

19. The downhole tool of claim 18, wherein the body comprises a recess in a surface of the cavity and the pre-manufactured erosion-resistant insert is positioned in the recess.

20. The downhole tool of claim 18, wherein the pre-manufactured erosion-resistant insert comprises a collar positioned in the port.

* * * * *